US010626563B2

(12) United States Patent
Vogt et al.

(10) Patent No.: US 10,626,563 B2
(45) **Date of Patent: *Apr. 21, 2020**

(54) SELF-PROPELLED CONSTRUCTION MACHINE AND METHOD FOR OPERATING A SELF-PROPELLED CONSTRUCTION MACHINE

(71) Applicant: Wirtgen GmbH, Windhagen (DE)

(72) Inventors: Andreas Vogt, Asbach (DE); Hanjo Held, Windhagen (DE); Christian Berning, Zülpich (DE); Cyrus Barimani, Königswinter (DE)

(73) Assignee: Wirtgen GmbH (DE)

( * ) Notice: Subject to any disclaimer, the term of this patent is extended or adjusted under 35 U.S.C. 154(b) by 0 days.

This patent is subject to a terminal disclaimer.

(21) Appl. No.: 16/000,068

(22) Filed: Jun. 5, 2018

(65) Prior Publication Data

US 2018/0340303 A1 Nov. 29, 2018

Related U.S. Application Data

(63) Continuation of application No. 14/955,611, filed on Dec. 1, 2015, now Pat. No. 9,995,009.

(30) Foreign Application Priority Data

Dec. 4, 2014 (DE) ..... 10 2014 017 892

(51) Int. Cl.
*E01C 23/08* (2006.01)
*E01C 23/088* (2006.01)
*E01C 23/12* (2006.01)

(52) U.S. Cl.
CPC ..... *E01C 23/088* (2013.01); *E01C 23/127* (2013.01)

(58) Field of Classification Search
CPC ..... E01C 23/088; E01C 23/127
See application file for complete search history.

(56) References Cited

U.S. PATENT DOCUMENTS 4,221,434 A 9/1980 Swisher et al.
4,723,867 A 2/1988 Wirtgen
(Continued)

FOREIGN PATENT DOCUMENTS

DE 102006024123 A1 11/2007
DE 102007044090 A1 4/2009
(Continued)

*Primary Examiner* — Janine M Kreck
(74) *Attorney, Agent, or Firm* — Lucian Wayne Beavers; Gary L. Montle; Patterson Intellectual Property Law, PC

(57) ABSTRACT

A self-propelled construction machine includes a machine frame and an operating drum arranged in a drum housing which is open downwards and is closed on both sides by an edge protector which is adjustable in height. A control assembly determines a reference value for the height of the ground surface relative to the machine frame on which the edge protector rests in a floating position, the height of the edge protector relative to the machine frame and the lowering speed of the edge protector. Furthermore, the control assembly is configured such that the height of the edge protector relative to the machine frame is determined at the point in time at which the lowering speed of the edge protector is less than a specified limit value. Preferred embodiments of the machine furthermore detect the edge protector sinking into the ground, and/or prevent the edge protector from digging into the ground.

20 Claims, 4 Drawing Sheets

(56) References Cited

U.S. PATENT DOCUMENTS

| | | | | |
|---|---|---|---|---|
| 5,315,770 | A | 5/1994 | Campbell | |
| 5,378,081 | A | 1/1995 | Swisher, Jr. | |
| 5,607,205 | A | 3/1997 | Burdick et al. | |
| 6,623,083 | B1 | 9/2003 | Risi | |
| 7,387,465 | B2 | 6/2008 | Hall et al. | |
| 7,530,641 | B2 | 5/2009 | Berning et al. | |
| 7,887,142 | B2 | 2/2011 | Hall et al. | |
| 8,047,741 | B2 | 11/2011 | Von Schonebeck et al. | |
| 8,246,270 | B2 | 8/2012 | Berning et al. | |
| 8,888,194 | B2 | 11/2014 | Killion | |
| 8,944,517 | B2 | 2/2015 | Franzmann et al. | |
| 9,016,798 | B2 | 4/2015 | Berning et al. | |
| 9,995,009 | B2 * | 6/2018 | Vogt | E01C 23/088 |
| 2002/0047301 | A1 | 4/2002 | Davis | |
| 2008/0153401 | A1 | 6/2008 | Wuensch et al. | |
| 2009/0108663 | A1 | 4/2009 | Berning et al. | |
| 2009/0232598 | A1 | 9/2009 | Cochran et al. | |
| 2012/0286558 | A1 | 11/2012 | Berning et al. | |
| 2013/0082508 | A1 | 4/2013 | Orefice | |
| 2013/0249271 | A1 * | 9/2013 | Killion | E01C 23/088 299/1.5 |
| 2014/0035343 | A1 * | 2/2014 | Berning | E01C 23/088 299/1.5 |

FOREIGN PATENT DOCUMENTS

| | | | |
|---|---|---|---|
| DE | 102010014529 | A1 | 10/2011 |
| DE | 102012015346 | A1 | 2/2014 |
| EP | 1012396 | A1 | 6/2000 |
| EP | 1936034 | A2 | 6/2008 |
| EP | 2050875 | A2 | 4/2009 |
| EP | 2374937 | A2 | 10/2011 |
| EP | 2574697 | A1 | 4/2013 |

* cited by examiner

SELF-PROPELLED CONSTRUCTION MACHINE AND METHOD FOR OPERATING A SELF-PROPELLED CONSTRUCTION MACHINE

BACKGROUND OF THE INVENTION

1. Field of the Invention

The invention relates to a self-propelled construction machine, in particular a road miller, stabiliser, recycler or surface miner, comprising a machine frame and an operating drum, the operating drum being arranged in a drum housing which is open downwards and is closed on both sides by an edge protector which is adjustable in height. Furthermore, the invention relates to a method for operating such a construction machine.

2. Description of the Prior Art

The above-mentioned construction machines have a rotating operating drum for processing ground material, which can be a milling or cutting drum. By means of the operating drum, for example, damaged road layers can be removed, existing road surfaces can be reprocessed, the land can be prepared for road construction, or mineral resources can be mined.

The operating drum of the known self-propelled construction machines is arranged in a drum housing which is open downwards and is closed by a hold-down device positioned in front of the operating drum in the working direction, and a stripper positioned behind the drum in the working direction. Shields extending in the working direction, which are referred to as edge protectors, close the drum housing at the sides.

The edge protector of the known self-propelled construction machines is adjustable in height relative to the machine frame. For this purpose, a lifting device is provided for raising and/or lowering the edge protector and provides a floating position for the edge protector in which the edge protector can follow height adjustments of the machine frame relative to the ground, for example when changing the milling depth of a road milling machine, or unevennesses in the terrain. In the floating position, the height of the edge protector can be adjusted by the lifting device such that the edge protector automatically lowers onto the surface of the ground from a raised position under its own weight, and after coming into contact with the ground surface, rests on the ground surface with a specified contact force. When the construction machine moves forward, the edge protector is then pulled over the ground. In this case, the edge protector may additionally be loaded with or relieved of a specified force by the lifting device.

The lifting device for raising and/or lowering the edge protector can be operated by the driver of the machine in order to make the operating drum accessible. During operation of the construction machine, however, the edge protector should always be lowered so that the drum housing is closed at the sides. Therefore, self-propelled construction machines have a circuit which does not permit the edge protector to be fixed in the raised position during operation of the machine.

In practice, in particular when driving over loose ground, there is the problem of the edge protector, which rests on the ground with the specified contact force, digging into the ground as the construction machine moves forward. This may lead not only to increased driving resistance and therefore increased fuel consumption, but also to increased wear or deformation of the edge protector. If the edge protector digs deeply into the ground, this may even cause the construction machine to come to a complete standstill.

A self-propelled construction machine which has a lifting device for raising and/or lowering the edge protector, which device provides floating mounting of the edge protector, is known from DE 10 2012 015 346 A1 (U.S. Pat. No. 9,016,798). The lifting device is actuated by a control unit which is configured such that when a specified value for the minimum distance between a reference point on the edge protector and the ground surface is not reached, the lifting device is shifted out of the floating position and the edge protector is raised. As a result, the edge protector is effectively prevented from being able to dig into loose ground. The edge protector comprises a resilient scanning element for scanning the ground surface, which is fastened to the edge protector such that when a specified value for the minimum distance between the reference point and the ground surface is not reached, the scanning element is deflected. The known construction machine works in practice; however, it is disadvantageous that an additional distance sensor is required on the edge protector, the resilient scanning element of which sensor is subjected to mechanical stresses.

SUMMARY OF THE INVENTION

The problem addressed by the invention is to reliably detect values relevant to the control of the edge protector of a self-propelled construction machine without increased design complexity. According to the invention, this problem is solved by the features of the independent claims. The subjects of the dependent claims relate to preferred embodiments of the invention.

In particular, the problem addressed by the invention is to control the edge protector of a self-propelled construction machine without components that are susceptible to wear such that there is no risk of the edge protector digging into loose ground. Another problem addressed by the invention is that of allowing more user-friendly and ergonomic operation of the construction machine.

The self-propelled construction machine according to the invention, in particular a road milling machine, stabiliser, recycler or surface miner, comprises a machine frame and an operating drum which is equipped with tools and is arranged in a drum housing which is open downwards and is closed on at least one side by an edge protector which is adjustable in height relative to the machine frame by a lifting device. Preferably, an edge protector is provided on either side of the drum housing in each case. The edge protector is adjustable in height relative to the machine frame in a floating position such that said edge protector lowers onto the surface of the ground from a raised position, and after coming into contact with the ground surface, rests on the ground surface with a specified contact force, and therefore the edge protector is pulled over the ground as the construction machine moves forward and can follow changes in the height of the ground surface relative to the machine frame.

The construction machine according to the invention is distinguished by a unit for determining a reference value for the height of the surface of the ground relative to the machine frame on which the edge protector rests. Whether absolute or relative values are available for the height of the ground surface is irrelevant to the invention. It is decisive that the height of the ground surface is determined in relation to the machine frame, i.e. of any reference point or a reference line on or at the machine frame.

The unit for determining a reference value for the height of the ground surface has a device for determining the height of the edge protector relative to the machine frame and the lowering speed of the edge protector. How the height of the edge protector and the lowering speed thereof is determined is irrelevant to the invention. One or more sensors may be provided for this purpose. For example, the lowering speed may be calculated from the change over time of the height of the edge protector when lowering onto the ground surface.

Furthermore, the construction machine comprises an evaluation unit which is configured such that the height of the edge protector relative to the machine frame is determined at the point in time at which the lowering speed of the edge protector is less than a specified limit value for the lowering speed. If the lowering speed of the edge protector is less than the specified limit value, it is concluded that the lower edge of the edge protector is in contact with the ground. The limit value for the lowering speed should be ascertained such that the edge protector contacting the ground can also be reliably detected if the edge protector is intended to sink into loose ground. In this case too, the lowering speed when contacting the ground surface is considerably lower than during lowering onto the ground. The height of the ground surface relative to the machine frame results from the height of the edge protector that is resting on the ground surface. If the height of the ground surface relative to the machine frame is known, it is possible to detect the edge protector sinking into the ground. For this purpose, the actual height of the edge protector is determined and is compared with the height of the ground surface.

A preferred embodiment of the construction machine provides a unit for detecting the edge protector sinking into the ground, which unit is configured such that a control signal indicating the edge protector sinking in is generated when the difference between the determined reference value for the height of the ground surface and the actual height of the edge protector relative to the machine frame is greater than a specified limit value for the sinking-in depth of the edge protector. This preferred embodiment thus makes it possible, by specifying a suitable limit value, to determine the sinking in of the edge protector.

A particularly preferred embodiment provides a control unit, which receives the control signal from the unit for detecting the edge protector sinking in, for the lifting device, the control unit being configured such that the edge protector is raised when the control unit receives the control signal. When the control unit for the lifting device receives the control signal, the control unit shifts the operation of the edge protector from the floating position into an operating state in which the edge protector is raised. This ensures that the edge protector cannot sink further into the ground. Once the edge protector has sunk into the ground by a specified amount, the edge protector is automatically raised again, so that it can lower onto the ground again. As a result, the edge protector reaches a defined position again.

The edge protector is preferably raised by a specified distance which is greater than the limit value for the sinking-in depth. This ensures that the lower edge of the edge protector is positioned above the terrain surface, so that the edge protector can automatically lower onto the terrain surface again.

In another particularly preferred embodiment, jerky movements of the edge protector are prevented by the control unit being configured such that the duration for which the edge protector is resting on the ground surface is detected. The edge protector is only raised if the control unit for the lifting device receives the control signal and the duration is longer than a specified minimum duration.

The automatic control of the edge protector gives the machine driver the key advantage that he does not constantly have to monitor and correct the height of the edge protector during operation of the construction machine. This is an advantage in that the height of the edge protector can only be assessed with difficulty from the driver's platform and it is not always possible to detect that the edge protector is digging in.

An additional distance sensor is not required in the construction machine according to the invention and the method for operating the construction machine according to the invention. The sensor technology required for the invention is generally already available in the known construction machines. Since additional, in particular mechanical, components are not available, there is not the problem of damage or wear to these parts either. A further advantage consists in that the control according to the invention can be implemented in the control of the various machine types. The geometric dimensions of the machine are immaterial in that the edge protector can consistently assume a defined position after being raised in the floating position, i.e. it automatically lowers onto the terrain surface.

In practice, it cannot be ruled out that the edge protector may become jammed in the guide. The lowering speed is then zero. Since the lowering speed of the edge protector is monitored, this malfunction can be detected immediately, and therefore a suitable intervention in the machine control can be made. This is another key advantage of the invention.

In another particularly preferred embodiment, the control unit is configured such that when lowering the edge protector, the maximum value for the lowering speed of the edge protector is determined, a specified percentage for the maximum value for the determined lowering speed of the edge protector being adopted as the specified limit value for the lowering speed. By determining the maximum speed, a suitable limit value can be ascertained for the lowering speed. Furthermore, the edge protector jamming in the guide thereof can therefore be reliably detected.

In a construction machine of which the machine frame is supported by a chassis, which comprises front or rear wheels or running gears which can be raised or lowered relative to the machine frame, the operating drum is generally arranged on the machine frame. As a result, the machining depth of the operating drum, in particular the milling depth of the milling drum of a road milling machine, can be set by raising and lowering the machine frame. By changing the milling depth, however, the height of the edge protector that is resting on the ground surface also changes relative to the machine frame. This means that the determined reference value for the height of the ground surface is incorrect. Another particularly preferred embodiment therefore provides that the unit for determining a reference value for the height of the ground surface is configured such that the reference value for the height of the ground surface is corrected by the distance by which the machine frame is lowered relative to the ground surface by raising the wheels or running gears relative to the machine frame and/or is raised by lowering the wheels or running gears relative to the machine frame. If the machine frame is raised relative to the ground surface by lowering the wheels or running gears, it is, however, not absolutely necessary to correct the reference value, since when the milling depth decreases, the edge protector automatically lowers onto the ground surface again. Without a correction to the reference value, the control unit interprets the lowering of the edge protector as the edge protector sinking into the ground because the milling depth decreases, whereupon the control unit raises the edge protector again so that a new reference value is determined. However, the edge protector can be prevented from being unnecessarily raised and lowered for determining a new reference value by the reference value also being corrected if the machine frame is raised to decrease the milling depth.

How the device for raising and/or lowering the edge protector is configured is irrelevant to the invention. For example, just one device can be provided for raising a loosely guided or suspended edge protector, which rests on the ground surface due to its weight, so that the edge protector is mounted in a floating manner. In a particularly preferred embodiment, the lifting device for raising the edge protector comprises at least one piston-cylinder arrangement, the cylinder having an articulated connection to the machine frame and the piston having an articulated connection to the edge protector, or the cylinder having an articulated connection to the edge protector and the piston having an articulated connection to the machine frame. In this embodiment, the device for determining the height and the lowering speed of the edge protector comprises at least one odometer that detects the position of the piston of the at least one piston-cylinder arrangement. By deducing the distance measurement signal from the odometer, the lowering speed of the edge protector can be determined, and therefore additional sensors are not required.

BRIEF DESCRIPTION OF THE DRAWINGS

In the following, an embodiment of the invention will be described in greater detail on the basis of a road milling machine with reference to the drawings, in which.

DETAILED DESCRIPTION

Figure 1:
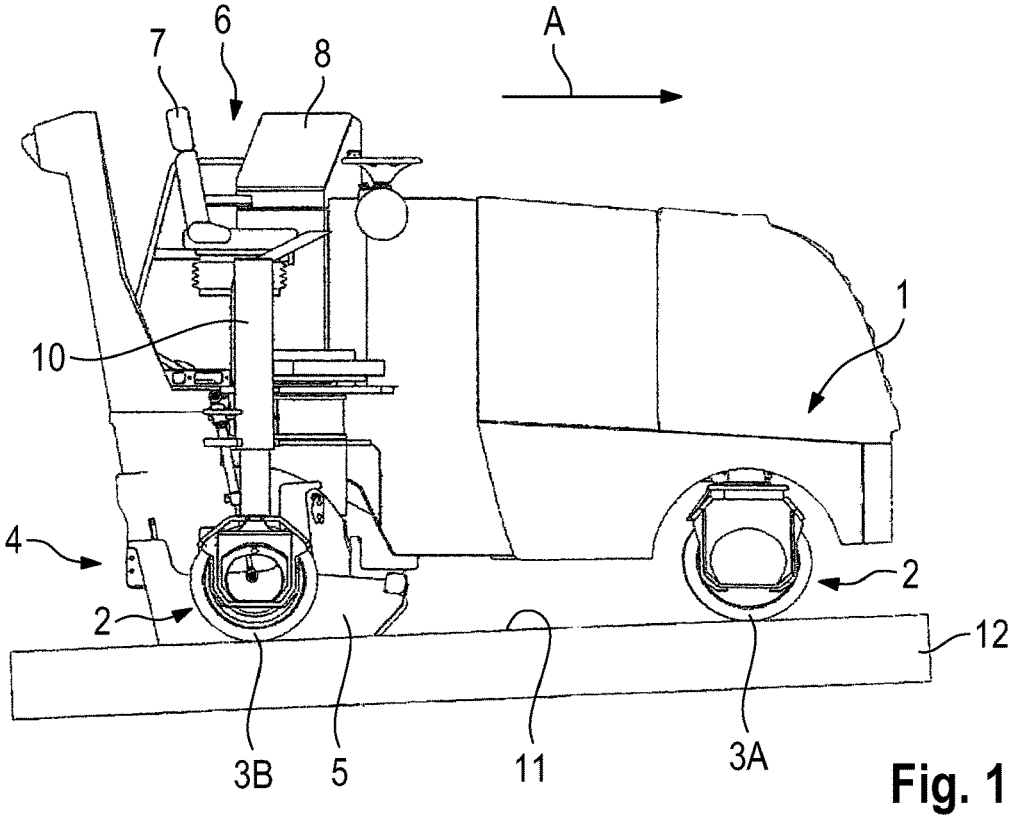
FIG. 1 is a side view of a road milling machine.

FIG. 1 is a side view of an embodiment of a road milling machine, which is a small miller. The road milling machine has a machine frame 1 which is supported by a chassis 2. The chassis 2 has a front wheel 3A and two rear wheels 3B. In FIG. 1, only the rear wheel 3B on the right-hand side in the working direction A is visible. In the known construction machines, the chassis can also have crawler tracks instead of wheels, for example.

The milling machine has an operating drum (not shown in FIG. 1), which is a milling drum, and said drum is arranged on the machine frame 1 in a milling drum housing 4. The milling drum housing 4 is closed on the left and right sides in the working direction A by an edge protector 5. Only the edge protector 5 on the right-hand side in the working direction A is visible in FIG. 1. The driver's platform 6 of the milling machine is positioned above the milling drum housing 4, and comprises the driver's seat 7 and the control panel 8. The machine frame 1 of the milling machine can be adjusted in height on lifting columns 10 relative to the surface 11 of the ground 12.

Figure 2:
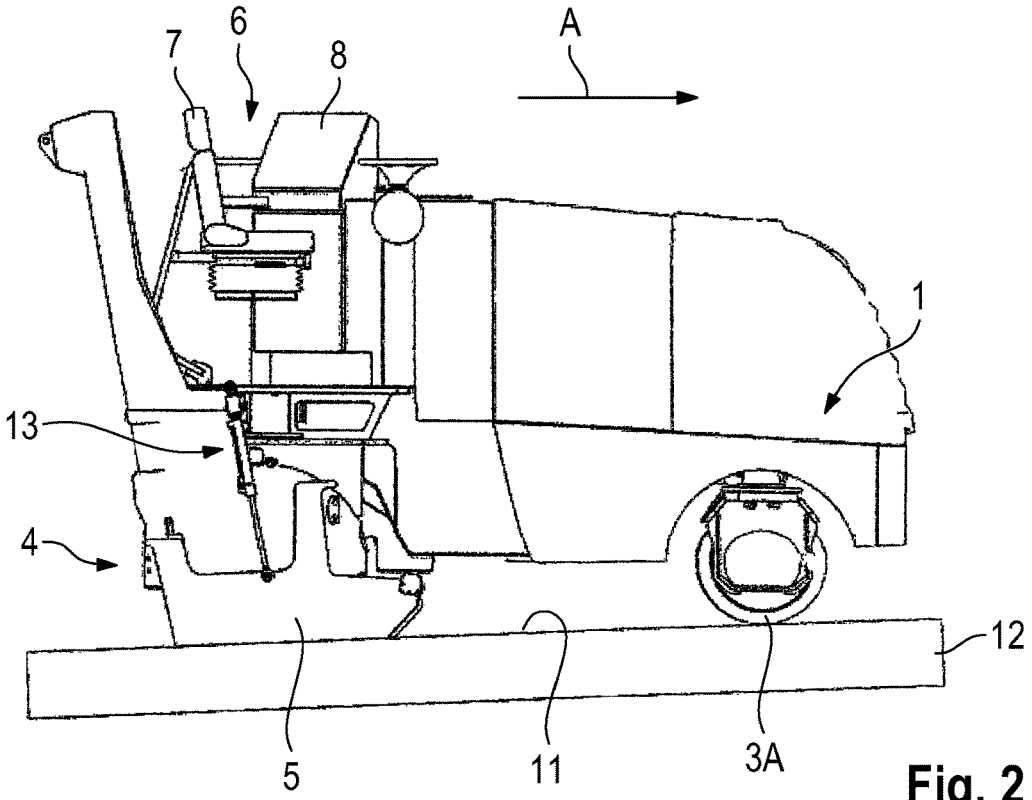
FIG. 2 shows the road milling machine from FIG. 1, the edge protector being exposed.
Figure 3:
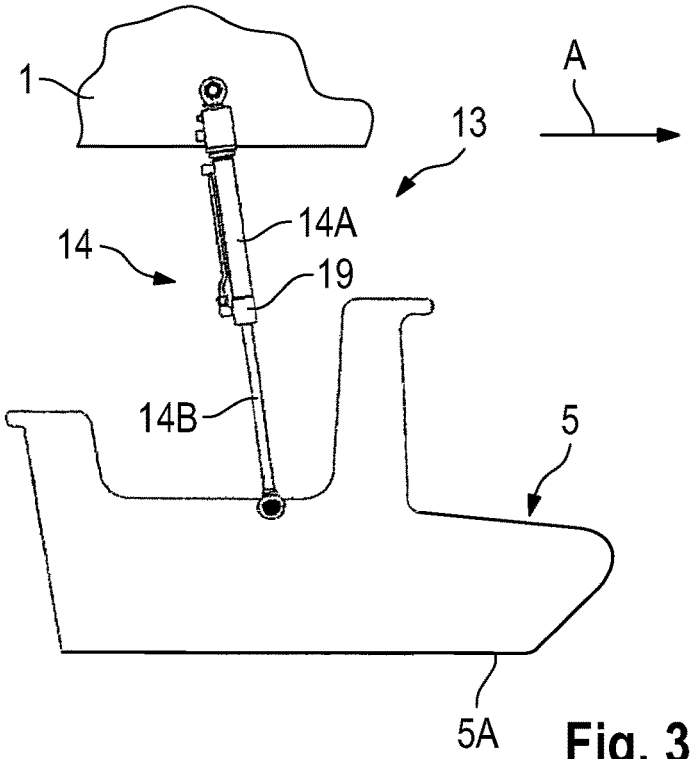
FIG. 3 shows the lifting device for raising the edge protector, together with the edge protector of the road milling machine from FIG. 1.

FIG. 2 shows the milling machine, the rear right-hand wheel 3B and the rear right-hand lifting column 10 not being shown, so that the right-hand edge protector 5 is visible. The left-hand and right-hand edge protectors 5 have the same structure. The edge protector 5 is formed by a metal plate which extends in the working direction A and is adjustable in height relative to the machine frame 1 between stops (not shown). Here, the edge protector 5 is mounted so that it can swing easily between the stops (FIG. 3).

The height of the edge protector 5 is adjusted by a lifting device 13 which comprises a piston-cylinder arrangement 14, the cylinder 14A of which is mounted on the machine frame 1 in an articulated manner and the piston 14B of which is mounted on the edge protector 5 in an articulated manner. The lifting device 13 may be referred to as a lifting assembly 13. The piston-cylinder arrangement 14 is operated by a hydraulic unit (not shown in FIG. 3). The edge protector 5 can be raised by retracting the piston 14B of the piston-cylinder arrangement 14.

The control of the edge protector provides a floating position for the edge protector. In the floating position, the edge protector 5 can lower out of a raised position due to its weight until the lower edge of the edge protector is resting on the ground surface 11. This movement is damped by the piston-cylinder arrangement 14, and therefore the edge protector 5 lowers relatively slowly and does not suddenly fall to the ground. The edge protector 5 resting on the ground surface is mounted in a floating manner such that said protector is pulled over the ground 12, so as to be resting on the ground surface 11, with a specified contact force as the road miller moves forward. In this case, the edge protector 5 can follow unevennesses in the ground. As a result, the milling drum housing 4 always remains closed at the sides. This floating mounting of the edge protector forms part of the prior art.

Figure 4:
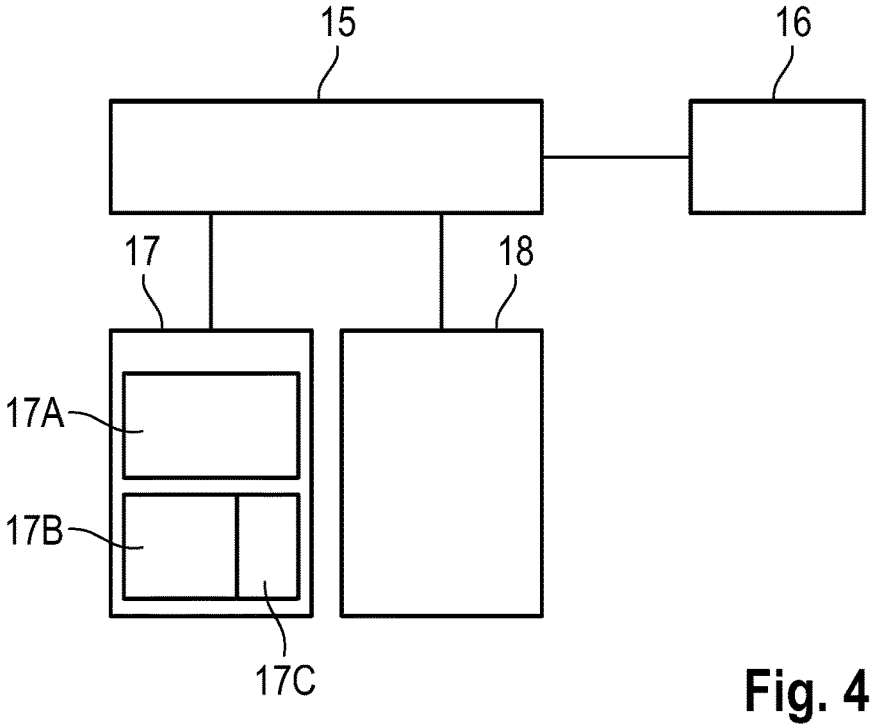
FIG. 4 shows a block diagram of the assemblies important for the control of the lifting device of the edge protector.

In the following, the control of the edge protector 5 is described in detail. FIG. 4 shows a block diagram of the assemblies important for the control of the lifting device 13 of the edge protector. FIGS. 5 to 8 show the individual positions which the edge protector 5 assumes.

The assemblies for the control of the lifting device 13 of the edge protector include a control unit 15 for controlling a hydraulic unit 16 for the lifting device 13 and a unit 17 for determining a reference value for the height of the ground surface 11 relative to the machine frame 1 and a unit 18 for detecting the edge protector sinking into the ground 12. The control unit 15 for controlling the hydraulic unit 16 for the lifting device 13 makes it possible to raise the edge protector and free the edge protector, and therefore the edge protector automatically lowers, i.e. shifts into the floating position.

The unit 17 for determining the reference value for the relative height $\Delta H$ of the ground surface relative to the machine frame 1 comprises a device 17A for determining the height $\Delta h$ of the edge protector 5 relative to the machine frame 1 and for determining the lowering speed v of the edge protector, and an evaluation unit 17B. The unit for determining the relative height Δh of the edge protector and the lowering speed v thereof comprises an odometer 19 that is integrated into the piston-cylinder arrangement 14 and generates a distance signal which indicates the relative height Δh of the edge protector relative to the machine frame 1. The distance signal is differentiated in order to determine a speed signal which indicates the lowering speed v of the edge protector. These two signals are processed by the evaluation unit 17B. The evaluation unit 17B continuously stores the data for the relative height of the edge protector and the lowering speed in a storage unit 17C, in order for it to be possible to calculate the maximum lowering speed $v_{max}$ from the data for the lowering speed v and to calculate a specified percentage from the maximum lowering speed $v_{max}$, which percentage is adopted as a specified limit value for the lowering speed. The percentage may for example be 50% of the maximum lowering speed $v_{max}$.

The relative height Δh of the edge protector 5 is the distance between any reference point or a reference line on or at the edge protector and any reference point or a reference line on or at the machine frame 1, and the relative height ΔH of the ground surface 11 is the distance between the ground surface and any reference point or a reference line on or at the machine frame 1.

The assemblies of the control may include a data processing unit (microprocessor) on which a data processing program (software) runs, so that the method steps described in the following are executed. The assemblies 15, 17, 18 of the control may collectively be referred to as a control assembly. One of skill in the art may appreciate that a data processing unit can be implemented as a single data processing unit or a plurality of the same (i.e., a plurality of microprocessors). One of skill in the art may further appreciate that the method steps or algorithms as described in connection with the embodiments disclosed herein can accordingly be executed directly via a data processor, via a software module executed by a data processor, or a combination of the two.

Figure 5:
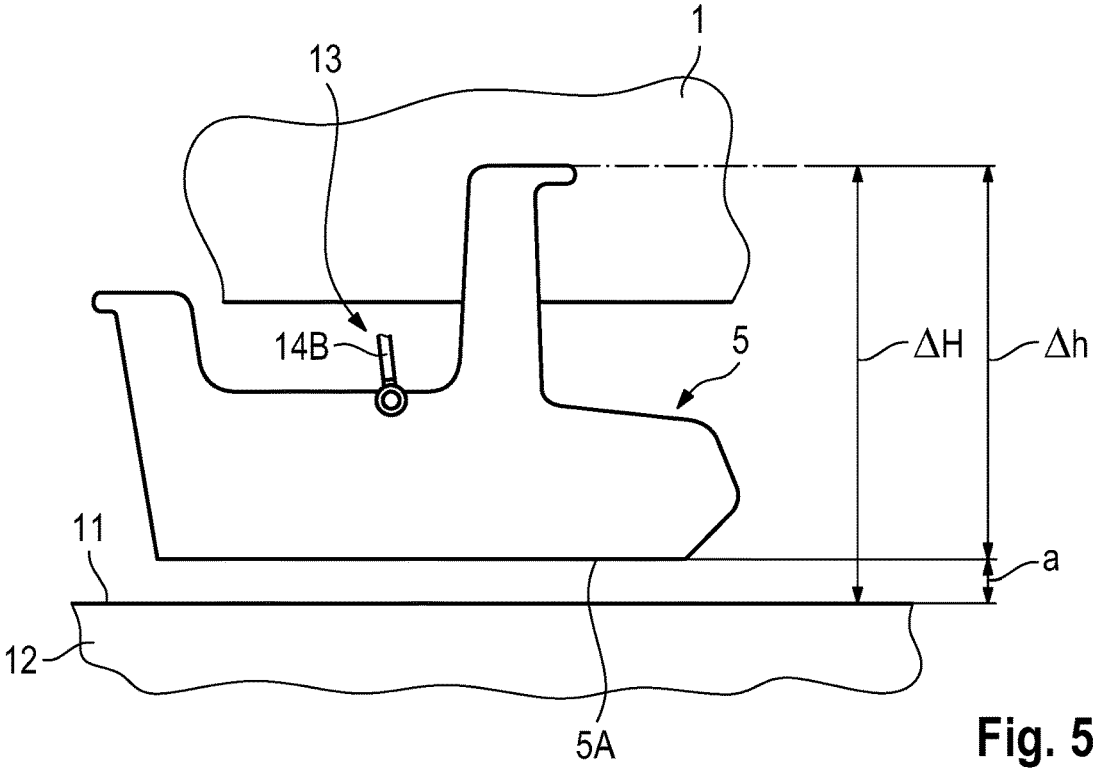
FIG. 5 shows the edge protector in a raised position in which the lower edge of the edge protector is arranged above the ground surface.
Figure 6:
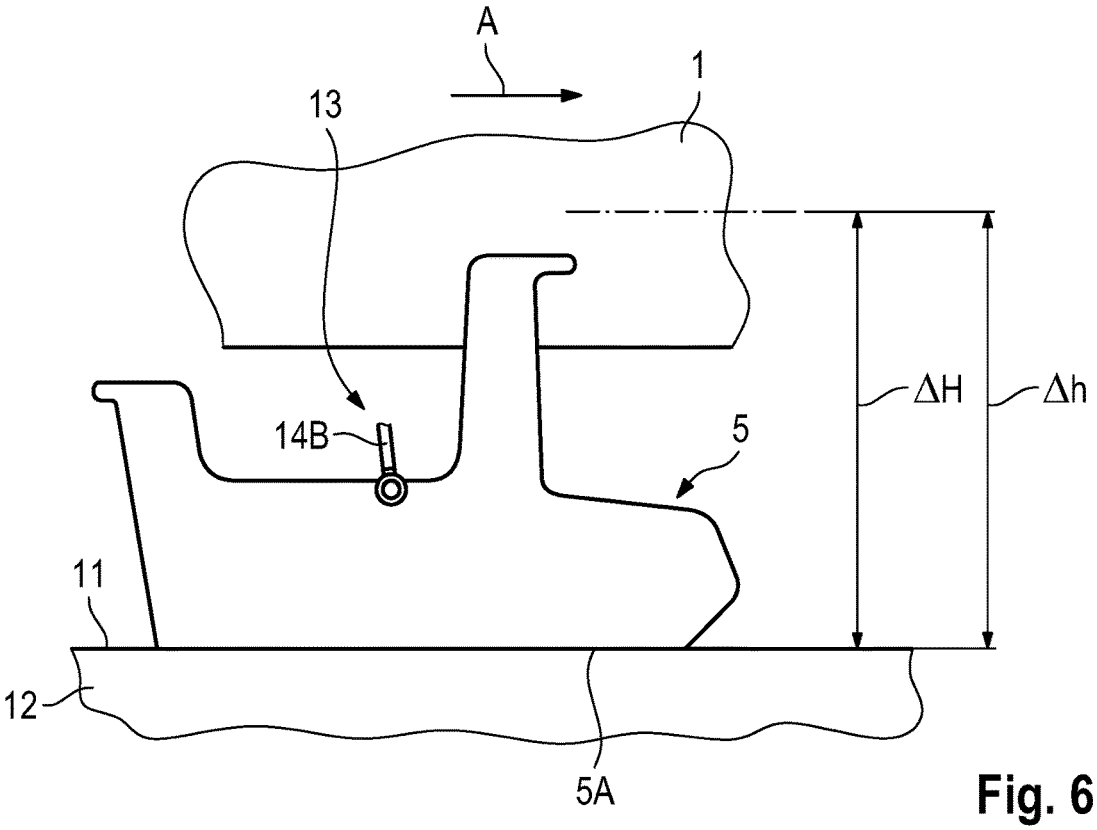
FIG. 6 shows the edge protector in a floating position in which the lower edge of the edge protector rests on the ground surface.

First, it is assumed that the edge protector, when in the floating position, rests on the ground surface, as shown in FIGS. 1 and 2 and FIG. 6. As the road miller moves forward, the control unit 15 actuates the hydraulic unit 16 of the lifting device 13 such that the edge protector 5 is raised by a specified distance a, which may be between 5 and 10 cm, for example. The specified distance may be detected by a distance measurement system. If a distance measurement system is not available, the edge protector 5 may for example also be raised for a specified time interval $\Delta t_1$, for example 250 ms, and this corresponds to the specified distance a. The edge protector is now in the raised position, as shown in FIG. 5. The edge protector is then freed, i.e. shifted into the floating position, so that it lowers onto the ground surface 11.

The data for the relative height Δh of the edge protector 5 relative to the machine frame 1 and the lowering speed v calculated from the change in height over time are input into the storage unit 17C in successive cycles as the edge protector is lowering $[v_1(t_1), v_2(t_2), v_3(t_3), \ldots v_n(t_n)]$.

The lowering speed determined in a subsequent cycle, for example $v_3(t_3)$, is compared in each case with the lowering speed determined in a preceding cycle, for example $v_2(t_2)$. If the lowering speed determined in the subsequent cycle is greater than the lowering speed determined in the preceding cycle, the subsequent lowering speed is stored in the storage unit as the maximum lowering speed $v_{max}$. The limit value for the lowering speed is calculated from the maximum lowering speed, for example a percentage for the maximum lowering speed $v_{max}$ which is also stored. During each cycle, the lowering speed currently being measured is compared with the determined limit value, for the lowering speed, that is read out from the storage unit. Once the current lowering speed v is lower than the limit value, it is concluded that the lower edge 5A of the edge protector 5 has come into contact with the ground surface 11. The relative height Δh of the edge protector 5 at this point in time is adopted as the relative height of the terrain surface ΔH (ΔH=Δh). This value is stored in the storage unit 17C.

FIG. 6 shows the edge protector 5 in the floating position, the edge protector 5 resting on the ground surface 11. If the edge protector is expected to penetrate the ground 12 because it is loose or soft, the height of the edge protector is changed in relation to the height of the ground.

Figure 7:
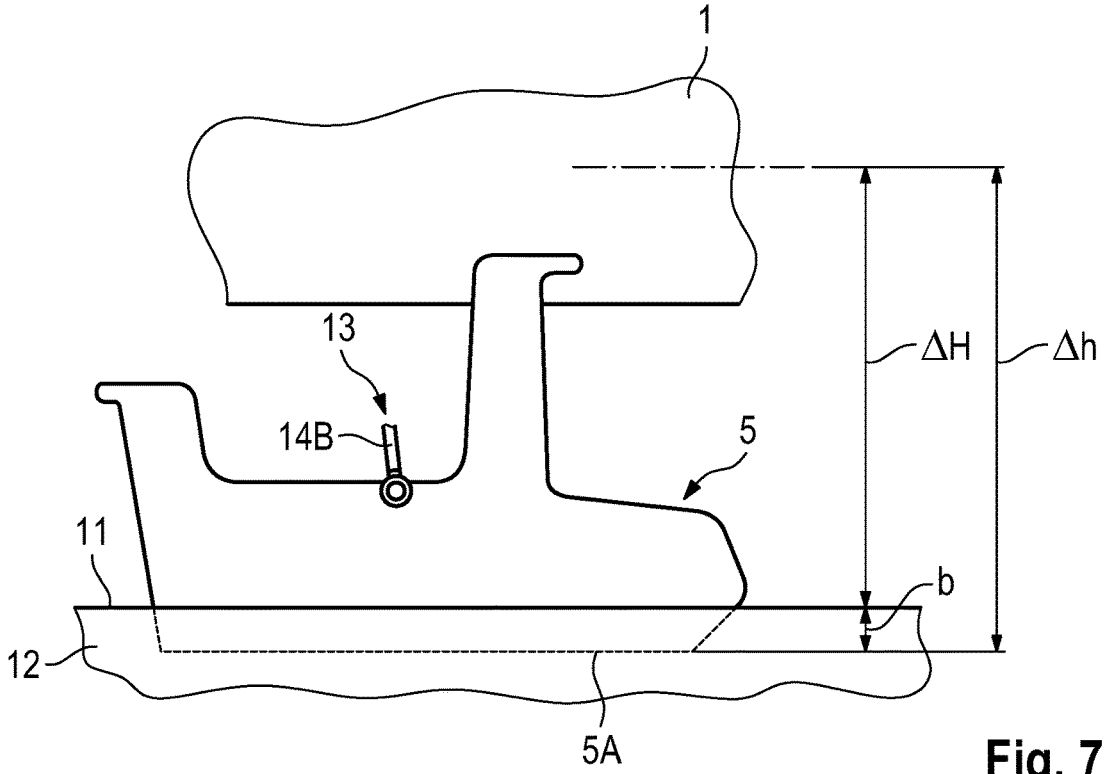
FIG. 7 shows the edge protector in a floating position in which the edge protector has sunk into the ground.

FIG. 7 shows the edge protector 5, the lower edge 5A of which is below the terrain surface 11. The penetration depth b of the edge protector 5, i.e. the height difference b, is detected by the unit 18 for detecting the edge protector sinking in. This unit 18 generates a control signal indicating the edge protector sinking in when the difference between the previously determined reference value for the relative height of the ground surface and the currently determined actual relative height of the edge protector is greater than a specified limit value for the sinking-in depth b of the edge protector. The control signal is for example generated when the lower edge 5A of the edge protector 5 is in a region that is for example 1 to 2 cm below the terrain surface 11.

Figure 8:
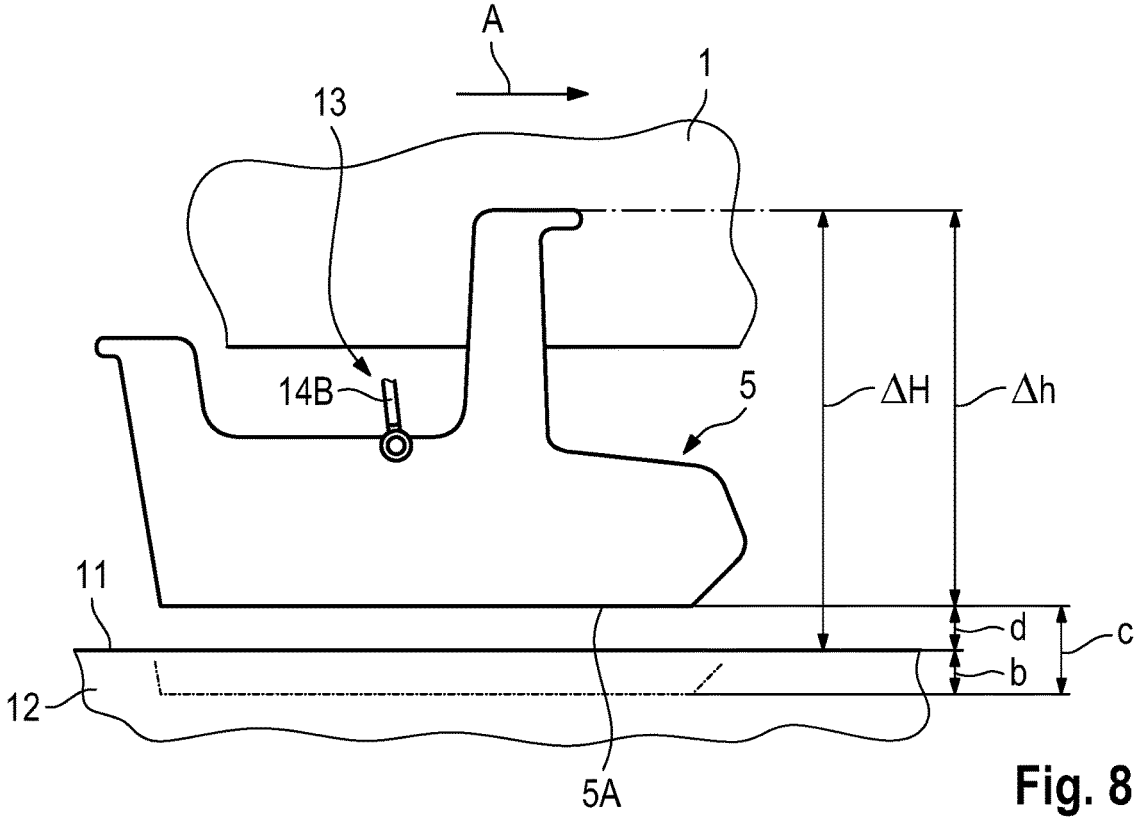
FIG. 8 shows the edge protector in a raised position, after the edge protector has been raised by a specified distance.

If the control unit 15 receives the control signal, said unit actuates the hydraulic unit 16 of the lifting device 13 such that the edge protector 5 is raised by a specified distance c or for a specified time interval $\Delta t_2$, so that the lower edge 5A of the edge protector 5 is positioned above the terrain surface 11 again. FIG. 8 shows the edge protector 5 in the position in which it is raised by the specified distance c and in which the lower edge 5A of said edge protector is positioned at a distance d above the terrain surface 11. The specified distance c by which the edge protector 5 is raised is greater than the sinking-in depth b. Furthermore, the control unit 15 frees the edge protector 5 again, i.e. the edge protector returns to the floating position, so that the edge protector lowers onto the ground 12 again (FIG. 6).

The above-described method steps are carried out as the road miller moves forward. If the edge protector 5 is intended to sink into the ground 12 again, this is detected again. The edge protector 5 is then raised again so that the edge protector can lower onto the ground again. This ensures that the edge protector 5 cannot dig into the ground 12. The distance a or the time interval $\Delta t_1$ is preferably equal to the distance c or the time interval $\Delta t_2$, i.e. the edge protector is always raised by the same amount in undetermined time periods during operation of the construction machine depending on the nature of the ground.

The control unit 15 is also configured such that the duration for which the edge protector 5 is resting on the ground surface in the floating position is detected. If the control unit 15 receives the control signal, said unit only raises the edge protector 5 if the specified duration Δt, which may for example be between 2 and 4 seconds, is exceeded, so that the edge protector is not constantly moved. The edge protector may, however, also be raised depending on the distance, the distance which is covered by the edge protector, which is resting on the ground and is in the floating position, being detected. The edge protector is only raised by the control unit after said unit has received the control signal if a specified distance, for example 1 to 3 m, is exceeded.

If the lifting columns 10, by means of which the wheels 3A, 3B, to which the machine frame 1 is attached, are retracted, the height of the machine frame 1 and the milling drum relative to the ground surface 11 is reduced, so that milling drum penetrates more deeply into the ground 12. This increases the milling depth. This results in the edge protector 5 being raised relative to the machine frame 1. In this case, the unit 17 for determining the reference value for the height of the ground surface corrects the reference value determined for the previously set milling depth by the amount by which the machine frame 1 has been lowered relative to the ground surface 11 or by which the milling depth has been increased. In order to determine the corrected reference value, the difference between the previously determined reference value and the value by which the machine frame 1 has been lowered or by which the milling depth has been increased is calculated. This corrected reference value then forms the basis for the further control of the edge protector. If the milling depth is decreased, i.e. the machine frame 1 is raised relative to the ground surface so that the edge protector lowers, the reference value is corrected in a similar manner.

For the control of the edge protector, it is in principle sufficient to determine a single reference value for the height (ΔH) of the ground surface (11) relative to the machine frame (1). This reference value may form the basis of the control. A new reference value is only determined if the edge protector has sunk into the ground and is raised again. However, it is also possible to currently determine new reference values for the height (ΔH) of the ground surface (11) relative to the machine frame (1), i.e. to update the reference values. For this purpose, the control unit (15) for the lifting device (13) is configured such that, irrespective of whether the edge protector has sunk into the ground, the edge protector is successively raised in a time-dependent or distance-dependent manner after a specified time interval has elapsed or a specified distance has been covered, so that the edge protector can lower onto the ground surface again.

The invention claimed is:

1. A self-propelled construction machine, comprising:

a machine frame;

an operating drum arranged in a drum housing, wherein the housing is downwardly open and encloses the drum on at least one side by a height-adjustable edge protector;

wherein the edge protector is configured in a floating state to automatically lower onto a surface of the ground from a raised position and, after coming into contact with the ground surface, to engage the ground surface with a specified contact force and follow changes in a height of the ground surface relative to the machine frame as the construction machine moves forward;

one or more sensors configured to generate at least a distance signal indicating an actual height of the edge protector relative to the machine frame; and a controller coupled to receive the at least the distance signal from the one or more sensors and configured to generate a control signal indicating that the edge protector is sinking into the ground when a difference between a reference value for the height of the ground surface and the actual height of the edge protector relative to the machine frame is greater than a specified limit value for a sinking-in depth of the edge protector.

2. The machine of claim 1, further comprising a lifting assembly configured to adjust a height of the edge protector relative to the machine frame, wherein the lifting assembly is actuated to raise the edge protector in accordance with generation of the control signal.

3. The machine of claim 2, wherein the edge protector is raised by a specified distance which is greater than the limit value for the sinking-in depth.

4. The machine of claim 2, wherein the controller is configured to detect a duration for which the edge protector is resting on the ground surface, and actuate the lifting assembly to raise the edge protector if the duration is longer than a specified minimum duration.

5. The machine of claim 2, wherein the controller is further configured to determine the reference value for a height of the ground surface relative to the machine frame and upon which the edge protector rests.

6. The machine of claim 5, wherein the controller is configured to determine the reference value by determining a height of the edge protector relative to the machine frame at a point in time at which a lowering speed of the edge protector is less than a specified limit value for the lowering speed.

7. The machine of claim 6, wherein the controller is configured when the edge protector lowers to the surface of the ground to determine a maximum value for a lowering speed of the edge protector, and adopt a specified percentage of the determined maximum value for the lowering speed of the edge protector as a specified limit value for the lowering speed.

8. The machine of claim 1, wherein the machine frame is supported by a chassis comprising front or rear wheels or running gears configured to be raised or lowered relative to the machine frame, the operating drum is arranged on the machine frame, and the controller is configured to correct the reference value for the height of the ground surface by a distance that the machine frame is lowered relative to the ground surface via raising the wheels or running gears, or a distance that the machine frame is raised relative to the ground surface via lowering the wheels or running gears.

9. The machine of claim 2, wherein the lifting assembly comprises at least one piston-cylinder arrangement, the cylinder having an articulated connection to the machine frame and the piston having an articulated connection to the edge protector, or the cylinder having an articulated connection to the edge protector and the piston having an articulated connection to the machine frame.

10. The machine of claim 9, comprising an odometer integrated into the piston-cylinder arrangement and configured to generate a distance signal based on a position of the piston of the at least one piston-cylinder arrangement, wherein the controller is configured to determine a lowering speed of the edge protector based on the distance signal from the odometer.

11. A method of operating a self-propelled construction machine having a machine frame and an operating drum arranged in a drum housing that is downwardly open and encloses the drum on at least one side by an edge protector, the method comprising:

with the edge protector in a raised position, shifting the edge protector to a floating state wherein the edge protector is configured to automatically lower onto a surface of the ground and, after coming into contact with the ground surface, to engage the ground surface with a specified contact force and follow changes in a height of the ground surface relative to the machine frame as the construction machine moves forward;

determining an actual height of the edge protector relative to the machine frame; and generating a control signal indicating that the edge protector is sinking into the ground when a difference between a reference value for the height of the ground surface and the actual height of the edge protector relative to the machine frame is greater than a specified limit value for the sinking-in depth of the edge protector.

12. The method of claim 11, further comprising selectively raising the edge protector from the ground surface in response to the control signal.

13. The method of claim 12, wherein the step of selectively raising the edge protector from the ground surface comprises raising the edge protector by a specified distance which is greater than the limit value for the sinking-in depth.

14. The method of claim 12, further comprising detecting a duration for which the edge protector is resting on the ground surface, wherein the step of selectively raising the edge protector from the ground surface comprises raising the edge protector only if the duration is longer than a specified minimum duration.

15. The method of claim 12, further comprising automatically determining the reference value for the height of the ground surface.

16. The method of claim 15, comprising automatically determining the reference value by determining a height of the edge protector relative to the machine frame at a point in time at which a lowering speed of the edge protector is less than a specified limit value for the lowering speed.

17. The method of claim 16, further comprising raising the edge protector after a specified time interval has elapsed, so that the edge protector can lower onto the ground surface.

18. The method of claim 16, further comprising raising the edge protector after a specified distance has been covered, so that the edge protector can lower onto the ground surface.

19. The method of claim 16, further comprising:

determining a maximum value for a lowering speed of the edge protector; and adopting a specified percentage of the determined maximum value for the lowering speed of the edge protector as the specified limit value for the lowering speed.

20. The method of claim 11 for operating a self-propelled construction machine, of which the machine frame is supported by a chassis including front or rear wheels or running gears which can be raised or lowered relative to the machine frame, the operating drum being arranged on the machine frame, the method further comprising correcting the determined reference value for the height of the ground surface by a distance that the machine frame is lowered relative to the ground surface via raising of the wheels or running gears relative to the machine frame, or by a distance that the machine frame is raised relative to the ground surface via lowering of the wheels or running gears relative to the machine frame.

* * * * *